US005967429A

United States Patent [19]

Ulfik et al.

[11] Patent Number: 5,967,429

[45] Date of Patent: Oct. 19, 1999

[54] METHOD AND APPARATUS FOR THE METERED FEED OF COARSE GRANULAR MATERIAL INTO AN AIR JET MILL

[75] Inventors: Benno Ulfik, Leverkusen; Mathias Benz, Bergisch Gladbach, both of Germany

[73] Assignee: Bayer Aktiengesellschaft, Leverkusen, Germany

[21] Appl. No.: 09/074,800

[22] Filed: May 8, 1998

[30] Foreign Application Priority Data

May 15, 1997 [DE] Germany ..... 197 20 297

[51] Int. Cl.[6] ..... B02C 19/06

[52] U.S. Cl. ..... 241/5; 241/33; 241/39

[58] Field of Search ..... 241/5, 39, 30, 241/33; 406/3, 14

[56] References Cited

U.S. PATENT DOCUMENTS

| | | | |
|---|---|---|---|
| 2,763,437 | 9/1956 | Marchant | 241/39 |
| 4,592,302 | 6/1986 | Motoyama | 118/303 |
| 4,668,130 | 5/1987 | Sharp | 406/14 |
| 4,679,704 | 7/1987 | Dunlop et al. | 222/56 |
| 4,917,309 | 4/1990 | Zander | 241/5 |
| 4,936,280 | 6/1990 | Langlois | 123/578 |
| 5,407,305 | 4/1995 | Wallace | 406/14 |
| 5,494,381 | 2/1996 | Heyl et al. | 406/14 |
| 5,517,974 | 5/1996 | Akase | 123/533 |
| 5,813,801 | 9/1998 | Newbolt et al. | 406/14 |

FOREIGN PATENT DOCUMENTS

| | | | |
|---|---|---|---|
| 026742A2 | 8/1988 | European Pat. Off. | B02C 19/06 |
| 0604034A1 | 6/1994 | European Pat. Off. | B02C 19/06 |

*Primary Examiner*—Joseph J. Hail, III
*Assistant Examiner*—William Hong
*Attorney, Agent, or Firm*—Sprung Kramer Schaefer & Briscoe

[57] ABSTRACT

For the metered feed of coarse granular material into an air jet mill an injector 3 operated by propellent air is used, the coarse material being fed continuously to a closed injector hopper 6 provided on the injector 3. In the injector hopper 6, the pressure is measured at a product-free point and, by resetting the propellent air mass flow at the injector 3 is held constant at a preselected setpoint partial vacuum value. Said setpoint value is preferably set so low that at said pressure there is only just no return flow from the injector 3 into the injector hopper 6. The apparatus for effecting said method comprises a control loop having a pressure sensor 16 for measuring the flow in the closed injector hopper 6, a motor-adjustable valve 4, 5 as an actuator for varying the supplied propellent air mass flow and a loop controller, which compares the actual pressure value with a preselected setpoint value and supplies a control signal for operating the actuator 4, 5.

9 Claims, 1 Drawing Sheet

METHOD AND APPARATUS FOR THE METERED FEED OF COARSE GRANULAR MATERIAL INTO AN AIR JET MILL

The invention relates to a method for the metered feed of coarse granular material into an air jet mill, whereby the coarse material to be milled is blown into the air jet mill by means of an injector operated by propellent air. The invention further relates to an apparatus for effecting the method, which comprises an injector supplied with propellent air, an injector hopper provided on the injector and a metering element connected to the injector funnel for loading the injector hopper with the coarse powdery material which is to be milled.

BACKGROUND ART

Jet mills are operated by compressed air, inert gas or steam as a propellant. For the sake of simplicity, it is always compressed air which is mentioned as a propellant (by way of example) in the following description. When charging product by means of injectors into jet mills and, in particular, into spiral jet mills, blow-back may occur, for example, when the injector collecting nozzle (Venturi meter) builds up an insufficient counterpressure compared to the mill internal pressure or is caked with product. The mill internal pressure is dependent upon the milling chamber hold-up. During no-load operation, a high internal pressure has to be overcome. In many cases, this calls for collecting nozzles with a small mixing stage diameter. The mill internal pressure drops dramatically as soon as there is product in the milling chamber. In said state, it would be perfectly possible to select an injector collecting nozzle with a larger diameter. What actually often happens in practice is that a jet mill is operated with collecting nozzles which are as large as possible in order to facilitate the charging of products which are difficult to fluidize or which bake on. In said case, a continuous product feed has to be ensured because otherwise a return flow into the injector and into the product charging apparatus arises (blow-back). This calls for careful supervision by the attendant. Manufacturers of jet mills and, in particular, of spiral jet mills have not, up till now, offered automated supervision to prevent blow-back of the charged product at upstream injector metering devices.

SUMMARY OF THE INVENTION

The object of the invention is through instrumentation, to provide an arrangement whereby reliable and trouble-free operation of a jet mill without supervision by an attendant is possible and the metered addition of product is effected in each case in the optimum range. Furthermore, it is also to be possible to effect the start-up and shut-down process automatically from a supervisory console.

Said object is achieved according to the invention in that:

a) the coarse material is fed continuously to a closed, funnel-shaped injector hopper provided on the injector,
b) the pressure p at a product-free point in the injector hopper is measured and,
c) by resetting the propellent air mass flow at the injector, the pressure p in the injector hopper is held constant at a preselected setpoint partial vacuum value $p_0$.

The setpoint value $p_0$ is preferably preselected within a pressure range $p_1 \leqq p_0 \leqq p_2$, the upper limit value $p_2$ being characterized in that at said pressure there is only just no return flow from the injector into the injector hopper. In said manner, a minimization of the air quantity required to operate the injector may be achieved.

In practice, the setpoint value $p_0$ advantageously lies within a range of 1 mbar to 0.2 mbar partial vacuum (compared to normal pressure).

The closed-loop control advantageously takes the form of proportional control, i.e. the propellent air mass flow is reset in proportion to the pressure variation $\Delta p$ from the setpoint value $p_0$, measured in the injector hopper.

According to a further refinement of the invention, the milling air for the air jet mill and the product feed into the injector hopper are disconnected when the pressure in the injector hopper exceeds a limit value $p_3$ lying above the limit pressure $p_2$. By said means, in the event of unforeseen operating faults, the metering apparatus may be disconnected and blow-back of the powdery milling material from the metering apparatus into the environment may be reliably prevented.

In the case of sensitive products to be milled, it may be advantageous for an inert gas to act upon the milling material in the injector hopper. In said manner it is possible, e.g. in the case of hygroscopic products, to prevent the entry of ambient air or atmospheric humidity. Cases have moreover arisen where the surfaces of the milling material activated by the crushing operation during milling have been attacked by atmospheric oxygen. In such cases, it is then likewise advantageous to shroud the milling material in the injector hopper and load the air jet mill with inert gas.

For effecting the closed-loop control method, an apparatus has proved successful, which comprises an injector supplied with propellent air, an injector hopper provided on the injector and a metering element connected to the injector hopper for loading the injector hopper with the coarse material to be milled and according to the invention is characterized by a control loop, which comprises a pressure sensor for measuring the pressure p in the closed injector hopper, a motor-adjustable valve in the injector as an actuator for varying the supplied propellent air mass flow and a loop controller, which compares the actual pressure value p with a preselected setpoint value $p_0$ and supplies a control signal for operating the actuator and hence for minimizing the difference between the setpoint partial vacuum value and the actual partial vacuum value. Said pressure sensor is preferably disposed in the product-free area adjacent to the cover of the injector hopper.

The metering element for loading the injector hopper with the milling material advantageously comprises a proportioning feed screw.

With the invention the following advantages are achieved:

The controlled and, at the same time, minimized injector air supply results in an improved classifying action of the downstream air jet mill because the injector air represents a disturbance of the spiral flow in the milling chamber. Said disturbing influence is kept at the lowest possible level.

Furthermore by virtue of the controlled injector air minimization, new applications for incorporating jet mills into control concepts may be developed.

As the injector operates in each case with just the absolute minimum air quantity requirement, the product is charged gently into the milling chamber. Thus, in the case of extremely sticky or wearing products, the useful life of the collecting nozzle at the entrance into the jet mill is also prolonged.

There is also a slight saving on propellant (compressed air, nitrogen or steam).

The injector mouth is enclosed. Contamination by particles drawn in from the environment is ruled out, as is the intake of atmospheric oxygen when the procedure is rendered inert (supply of inert gas into the injector hopper).

The mill is protected against blow-back. As a result, environmental pollution by the product is reliably avoided (improved safety at work).

A side-effect is a substantial noise reduction.

The mill may moreover be operated with a collecting nozzle having a mixing stage diameter, which would be too large for reliable operation with an uncontrolled procedure.

The start-up and shut-down operation of the jet mill may be effected automatically.

BRIEF DESCRIPTION OF THE DRAWING

An embodiment of the invention with a closed-loop control device which is diagrammatically illustrated in the drawing.

DETAILED DESCRIPTION

Figure 1:
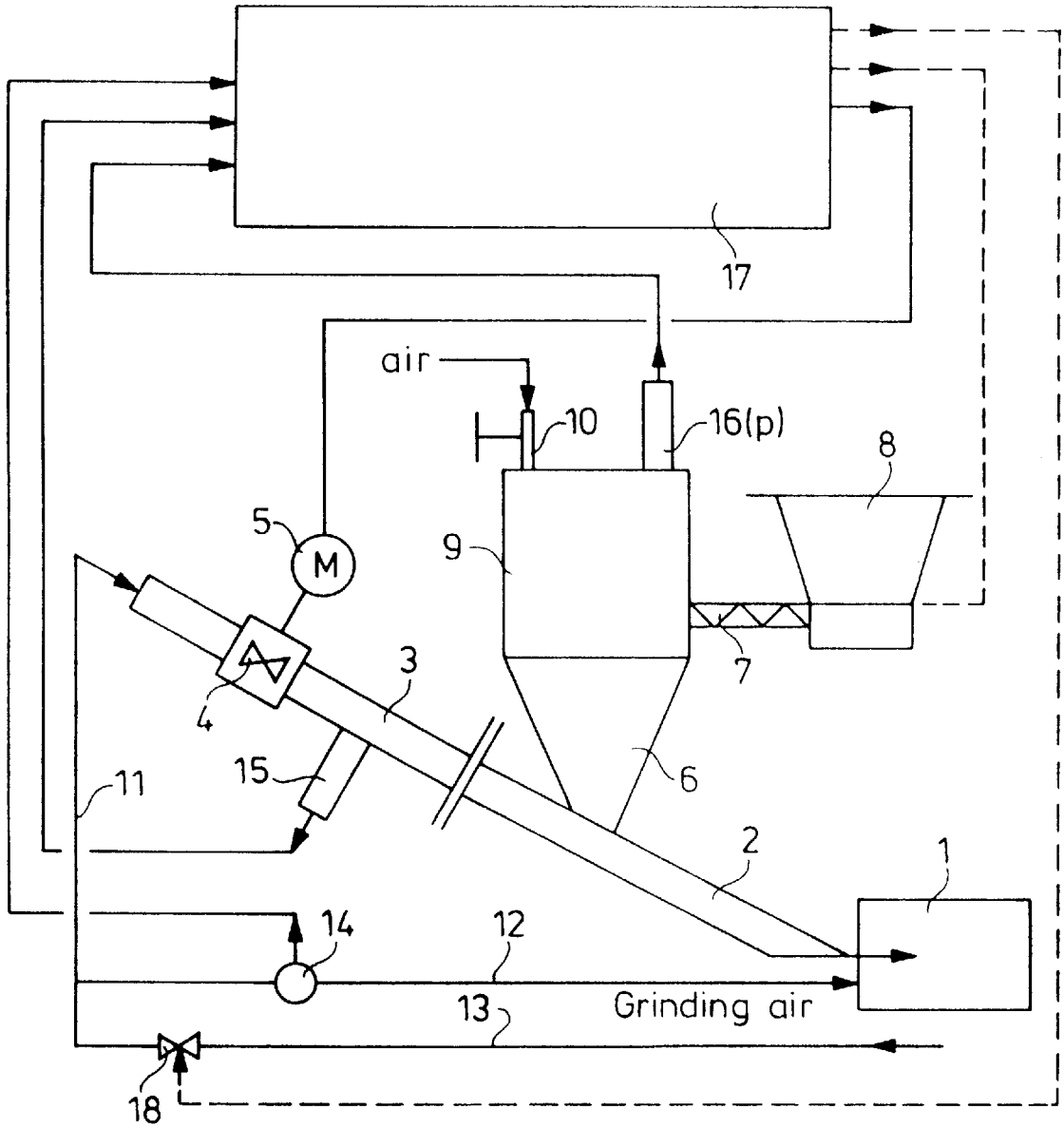

Air jet mills are currently used in the chemical industry largely for particle reduction. Said mills are notable for being simply designed, easy to clean and maintenance-friendly. Charging of the milling material is effected in said mills by means of an air jet injector metering apparatus disposed upstream of the jet mill.

The drawback is that the operation of jet mills is often very labour-intensive. For instance, in the case of extremely sticky products, baked-on deposits frequently form in the injector mouth. In extreme cases, this may lead to "blow-back" and to environmental pollution by the product. Attempts have therefore been made to discover operationally integrated solutions for control and regulating concepts, which substantially improve the operation and operational reliability of the mills in combination with an air jet injector metering apparatus.

The block diagram shows the air jet mill 1 with the injector metering apparatus 2. The latter comprises the air jet injector 3, having a valve 4 and a servomotor 5 for adjusting the valve opening cross section. Instead of a valve, an adjustable orifice might be used. Connected downstream of the valve 4 is an injector hopper 6, from which the powdery milling material is drawn in by the injector 3 and loaded with the injector air stream into the jet mill 1. The injector hopper 6 is loaded by means of a proportioning feed screw 7 with milling material from the charging container 8.

Air or an inert gas may be admitted through the connection piece 10 into the injector hopper 6, which is closed by a cover 9. The injector 3 and the jet mill 1 are supplied with compressed air through the lines 11 and 12 and the main line 13 respectively. Pressure sensors 14, 15 and 16 are inserted into the line 12, the injector 3 and the injector hopper 6. The sensor 14 measures the milling air operating pressure of the jet mill 1 and the sensor 15 measures the injector admission pressure. The pressure sensor 16, which is disposed in the product-free area adjacent to the cover 9 of the injector hopper 6, is used to measure the gas pressure in the injector hopper. All of the measured quantities are supplied to a control computer 17. By means of the valve 18, the operating pressure for the jet mill 1 and for the injector 3 may be adjusted.

The injector 3 initially generates in the closed injector hopper 6 a partial vacuum strong enough to produce an uncontrolled intake of milling material from the proportioning feed screw 7. Such an uncontrolled intake is avoided by the supply of inert gas or additional air, which is fed to the injector hopper 6 through the connection piece 10. By means of the additional air, the pressure level may be raised far enough to prevent an uncontrolled intake of product. Adjustment of the additional air is effected manually.

Naturally, the injectors when laden with product operate with a high air surplus. It is only during no-load operation that a high air quantity is required. The empty mill is started up at maximum injector admission pressure. The high admission pressure is needed for charging milling material counter to the mill internal pressure. When there is milling material in the mill, the mill internal pressure drops. The injector admission pressure may then be throttled back because only a lower counterpressure has to be overcome. The admission pressure is throttled back to such an extent that a minimal partial vacuum is constantly maintained in the injector region, which partial vacuum is to be just high enough to reliably prevent a blow-back of milling material from the injector hopper 6 into the environment. For said purpose, the closed-loop control system described below has been developed.

For adjusting the valve 4 in the injector 3, the sensor 16 together with the control computer 17 and the servomotor 5 forms a control loop, with the aid of which the pressure p in the injector hopper 6 is held constant. The servomotor 5 effects a reduction or enlargement of the opening cross section of the valve 4 and hence a decrease or increase of the propellent air mass flow in the injector 3. The decrease of the propellent air mass flow leads to a lowering and the increase leads to a raising of the partial vacuum p in the injector hopper 6. The setpoint value $p_0$ for the partial vacuum p is adjusted in the range $p_1$=1 mbar to $p_2$=0.2 mbar. Given a partial vacuum of 0.2 mbar, it is empirically still possible reliably to prevent a return flow from the injector 3 into the injector hopper 6.

When the feed of milling material decreases, the mill internal pressure rises. For trouble-free operation, an increase of the injector admission pressure is then required. This is effected by means of the control algorithm, which is stored in the control computer 17 and increases the injector admission pressure until a partial vacuum is restored. Analogously, the injector admission pressure may be reduced when the feed of milling material is increased.

Tests have shown that it is possible to operate the air jet mill automatically with said closed-loop control. The closed-loop control was capable of compensating variations in the milling material feed and in the compressed air supply. It is therefore possible to operate the air jet mill with the minimum injector air quantity without incurring the risk of milling material being blown out of the injector region into the environment. An added advantage of minimizing the injector air quantity is an improved classifying action of the jet mill because an incorrect air quantity charged through the injector has a negative influence upon the classifying action. It is moreover possible, in said manner, for the mill to be safely started up with a large collecting nozzle without having to accept unnecessarily large incorrect air quantities during operation.

A positive side-effect which arose as a result of enclosing the mouth region and minimizing the injector air was a perceptible reduction in the operating noise of the jet mill. During no-load operation, the noise emission was 105 dbA. With milling material in the milling chamber, the value dropped to <90 dbA. Given the enclosed construction with minimization of injector air, it was possible to reduce the noise emission to around 70 dbA.

When the detected variation from the setpoint value $p_0$ of the partial vacuum in the injector hopper 6 is no longer correctable by the injector air quantity, an emergency shutdown of the jet mill is provided. Said emergency shutdown operates in such a way that, when a limit value $p_3$ is exceeded in the injector hopper 6, a solenoid valve 18 in the central pressure supply line 13 is closed and the milling material feed is stopped through disconnection of the milling material proportioning feed screw 7. The threshold value for shutdown is in practice set at a value between 0.2 mbar and 0 mbar. It is thereby guaranteed that, even in the event of critical malfunctions, no milling material passes as a result of blow-back from the injector region into the environment.

We claim:

1. Method for feeding coarse granular material into an air jet mill (1), which comprises a) continuously feeding the coarse material to a closed, funnel-shaped injector hopper (6) provided on an injector (3) and supplying said injector (3) with propellent air to blow draw said coarse material out of said funnel-shaped injector hopper (6) and blow it into said air jet mill (1), b) measuring the pressure (p) at a product-free point in said closed, funnel-shaped injector hopper (6), comparing said measured pressure (p) to a preselected set point value ($p_0$) by a loop controller and, c) supplying a control signal from said loop controller to a motor adjustable valve which controls the mass flow rate of said propellant air and thereby resetting the propellant air mass flow rate to the injector (3) to maintain the pressure (p) in the injector hopper (6) constant at said preselected set point value ($p_0$), the term pressure being used herein in the absolute sense and including values above, equal to or below atmospheric pressure.

2. Method according to claim 1, further comprising preselecting the set point value ($p_0$) at a minimum value sufficient to prevent return flow from the injector (3) into the injector hopper (6).

3. Method according to claim 2, further comprising setting the set point value ($p_0$) within a range of 1 mbar pressure to 0.2 mbar partial vacuum.

4. Method according to claim 1, further comprising resetting the propellent air mass flow rate in proportion to the difference between the set point value ($p_0$) and the actual pressure (p) measured in the injector hopper (6).

5. Method according to claim 1 further comprising disconnecting the milling air for the air jet mill (1) and the product feed into the injector hopper (6) when the pressure in the injector hopper (6) exceeds a limit value $p_3$ lying above the limit pressure $p_2$.

6. Method according to claim 1, further comprising admitting inert gas into the injector hopper (6).

7. Apparatus for feeding coarse granular material into an air jet mill comprising an injector (3) supplied with propellent air, an injector hopper (6) provided on the injector (3) and a metering element (7) connected to the injector hopper (6) for loading the injector hopper (6) with the powdery, coarse material which is to be milled, characterized by a control loop having a pressure sensor (16) for measuring the pressure p in the closed injector hopper (6), a motor-adjustable valve (4, 5) in the injector (3) as an actuator for varying the supplied propellent air mass flow and a loop controller, which compares the actual pressure value p with a preselected setpoint value $p_0$ and supplies a control signal for operating the actuator (4, 5).

8. Apparatus according to claim 7, characterized in that the pressure sensor (16) is disposed adjacent to the cover (9) of the injector hopper (6).

9. Apparatus according to claim 7, characterized in that the metering element comprises a proportioning feed screw (7).

* * * * *